US006126403A

United States Patent [19]

Yamada

[11] Patent Number: 6,126,403

[45] Date of Patent: Oct. 3, 2000

[54] DIAPHRAGM PUMP

[75] Inventor: Kazumasa Yamada, Tokyo, Japan

[73] Assignee: Yamada T.S. Co., Ltd., Japan

[21] Appl. No.: 08/995,830

[22] Filed: Dec. 22, 1997

[30] Foreign Application Priority Data

Sep. 18, 1997 [JP] Japan ..... 9-253329

[51] Int. Cl.[7] ..... P04B 49/00

[52] U.S. Cl. ..... 417/46; 417/395

[58] Field of Search ..... 417/46, 392, 395; 91/274

[56] References Cited

U.S. PATENT DOCUMENTS

| | | | |
|---|---|---|---|
| 3,779,384 | 12/1973 | Stahlkopf | 210/136 |
| 4,093,403 | 6/1978 | Schrimpf et al. | 417/264 |
| 5,332,372 | 7/1994 | Reynolds | 417/393 |
| 5,378,122 | 1/1995 | Duncan | 417/395 |
| 5,927,954 | 7/1999 | Kennedy et al. | 417/397 |

*Primary Examiner*—Charles G. Freay
*Assistant Examiner*—David J. Torrente
*Attorney, Agent, or Firm*—Biebel & French

[57] ABSTRACT

A diaphragm pump is provided with a diaphragm defining a pump chamber and a drive chamber in the pump housing, a driving fluid is supplied to the drive chamber and a pump fluid is expelled from the pump chamber. The diaphragm pump is provided with pressure control means which, when the pressure in the pump chamber surpasses the pressure in the drive chamber neighboring the pump chamber across the diaphragm, controls the pressure of the driving fluid based upon output signals from pressure sensors in such a manner that the pressure in the fluid chamber will become higher than the pressure in the neighboring drive chamber. This makes it possible to prevent a diaphragm reversal phenomenon, wherein a diaphragm that should expand toward the pump chamber contracts toward the drive chamber instead during reciprocation of the diaphragm.

6 Claims, 8 Drawing Sheets

PRIOR ART

PRIOR ART

PRIOR ART

PRIOR ART

DIAPHRAGM PUMP

BACKGROUND OF THE INVENTION

This invention relates to improvements in a diaphragm pump of the type which discharges a pump fluid continuously by a diaphragm defining a pump chamber and a drive chamber.

A diaphragm pump according to the prior art has a structure shown in FIGS. 1 through 4. As illustrated in FIG. 4, a diaphragm 4 defining a pump chamber 2 and a drive chamber 3 is provided on one end of a reciprocating rod 1, and a diaphragm 7 defining a pump chamber 5 and a drive chamber 6 is provided on the 1. The diaphragm pump has a controller 8 and changeover control valves 9 and 10. When the reciprocating rod 1 is driven to one (a first) side (in the direction of arrow A), as illustrated in FIG. 1, a driving fluid (air, for example) is supplied to the drive chamber 3 on the first side of the reciprocating rod 1 to expel the pump fluid from the pump chamber 2 on this side. Meanwhile, driving fluid (air) in the drive chamber 6 on the other (a second) side of the reciprocating rod 1 is exhausted, during which time pump fluid is drawn into the pump chamber 5 on this side. FIG. 2 shows the conditions which prevail during the driving of the reciprocating rod to the first side.

When the control rod 1 reaches its stopping position on the first side, this stopping position is sensed by a proximity sensor 11, as depicted in FIG. 3, in response to which the changeover control valves 9, 10 are changed over so that driving fluid is supplied to the drive chamber 6 on the second side of the reciprocating rod 1 to drive the reciprocating rod 1 to this side (the direction of arrow B) and expel the pump fluid from the pump chamber 5 on this side. Meanwhile, driving fluid in the drive chamber 3 on the first side of the reciprocating rod 1 is exhausted, during which time pump fluid is drawn into the pump chamber 2 on this side. When the reciprocating rod 1 reaches its stopping position on the second side, this stopping position is sensed by a proximity sensor 12, as depicted in FIG. 4, in response to which the changeover control valves 9, 10 are changed over again to repeat the foregoing operation. Thus, the reciprocating rod 1 is reciprocated repeatedly to discharge the pump fluid continuously by this reciprocating motion.

During the reciprocation of the reciprocating rod 1, there are occasions where the pressure of the pump fluid expelled from one of the pump chambers exceeds the pressure of the driving fluid in the neighboring drive chamber for some reason. For example, if the pressure of the pump chamber surpasses the pressure in the drive chamber 3 for some reason during the movement of the reciprocating rod 1 to the first side (i.e., during the discharge of the pump fluid), there is the danger that the diaphragm 4, which should expand toward the side of the pump chamber 2, will contract toward the drive chamber 3, as indicated by the dashed line 4' in FIG. 2. This is referred to as a diaphragm reversal phenomenon. This phenomenon occurs also in a case where the pressure in the pump chamber 2 surpasses the pressure in the drive chamber 3 during movement of the reciprocating rod 1 to the second side (i.e., during the intake of the pump fluid into the pump chamber 2). (See the dashed line 4' in FIG. 3.)

When the diaphragm reversal phenomenon occurs, a situation arises in which stable, quantitatively accurate discharge of the pump fluid cannot be performed. If the diaphragm reversal phenomenon occurs frequently, moreover, the pump fluid undergoes agitation within the pump chamber. If the pump fluid contains fibers, the fibers will be destroyed by agitation resulting from the reversal phenomenon. If the pump fluid contains air bubbles, the air bubbles will be destroyed by agitation. Such destruction of fibers or air bubbles is undesirable. Furthermore, the service life of the diaphragms is shortened by the reversal phenomenon. This makes necessary the frequent replacement of the diaphragms and results in prolonged downtime. If the diaphragms tear because of shortened service life, outflow of the pump fluid can occur. This can result in a dangerous situation if the pump fluid is a toxic or hazardous substance.

SUMMARY OF THE INVENTION

Accordingly, an object of the present invention is to provide a diaphragm pump wherein the reversal phenomenon, in which a diaphragm, which should expand toward the side of the pump chamber, contracts toward the drive chamber, or vice versa, is prevented from occurring both when the diaphragm pump is operating and when it is at rest, whereby the flexing of the diaphragm is regularized so that the diaphragm is made to reverse correctly during pump operation to make possible the reliable and accurate pumping of fluid.

According to the present invention, the foregoing object is attained by providing a diaphragm pump for discharging a pump fluid continuously by a diaphragm defining a pump chamber and a drive chamber, comprising pressure control means for controlling pressure of a driving fluid, which is supplied to the drive chamber neighboring the pump chamber via the intermediary of the diaphragm, in such a manner that pressure in the drive chamber becomes higher than pressure in the pump chamber when the pressure in the pump chamber is equal to or greater than the pressure in the drive chamber, whereby reversal of the diaphragm is prevented independently of the pressure in the pump chamber.

In an embodiment of the present invention, the pressure control means includes a pressure sensor for sensing the pressure in the drive chamber, or a pressure sensor for sensing the pressure in the pump chamber, or pressure sensors for sensing the pressure in respective ones of the drive and pump chambers.

In the embodiment of the present invention, the diaphragm pump further comprises a connecting body for guiding reciprocation of the diaphragm.

The connecting body is a rod body, a plate body or a spring.

The diaphragm pump is further characterized in that the pressure control means is actuated when the pump fluid is traveling through the pump chamber.

Alternatively, the pressure control means is actuated when the pump fluid is not traveling through the pump chamber.

In another aspect of the present invention, the foregoing object is attained by providing a diaphragm pump, which has a pair of diaphragms each of which defines a pump chamber and a drive chamber, for discharging a pump fluid continuously by reciprocation of the pair of diaphragms, comprising pressure control means for controlling pressure of a driving fluid, which is supplied to the drive chambers neighboring the pump chambers via the intermediary of the respective diaphragms, in such a manner that pressure in the drive chambers becomes higher than pressure in the pump chambers when the pressure in the pump chambers is equal to or greater than the pressure in the drive chambers, whereby reversal of each diaphragm is prevented.

In an embodiment of the present invention, the pressure control means includes a pressure sensor for sensing the pressure in each drive chamber, or a pressure sensor for sensing the pressure in each pump chamber, or pressure sensors for sensing the pressure in each of the drive chambers and in each of the pump chambers.

In the embodiment of the present invention, the diaphragm pump further comprises a connecting body for guiding reciprocation of the diaphragm.

The connecting body is a rod body, a plate body or a spring.

The diaphragm pump is further characterized in that the pressure control means is actuated when the pump fluid is traveling through the pump chamber.

Alternatively, the pressure control means is actuated when the pump fluid is not traveling through the pump chamber.

In a further aspect of the present invention, the foregoing object is attained by providing a diaphragm pump including a connecting body having two ends each of which is provided with a diaphragm defining a pump chamber and a drive chamber, and a control circuit for controlling reciprocation timing of the connecting body as well as timing at which supply of a driving fluid to each of the drive chambers is changed over, wherein when the connecting body is driven toward a first side thereof, the driving fluid is supplied to the drive chamber located on the first side of the connecting body, pump fluid is expelled from the pump chamber located on the first side and pump fluid is drawn into the pump chamber located on a second side of the connecting body while driving fluid is discharged from the drive chamber located on the second side, and when the connecting body is driven toward the second side thereof, the driving fluid is supplied to the drive chamber located on the second side of the connecting body, pump fluid is expelled from the pump chamber located on the second side and pump fluid is drawn into the pump chamber located on the first side of the connecting body while driving fluid is discharged from the drive chamber located on the second side, whereby the pump fluid is discharged continuously by reciprocation of the connecting body, the diaphragm pump comprising a pressure sensor provided in each pump chamber for sensing pressure of the pump fluid in each pump chamber, a pressure sensor provided in each drive chamber for sensing pressure of the driving fluid in each drive chamber, and pressure control means for controlling the pressure of the driving fluid based upon output signals from both of the pressure sensors in such a manner that the pressure of the driving fluid in each drive chamber neighboring each pump chamber becomes higher than the pressure of the pump fluid in the pump chamber when the pressure of the pump fluid in the pump chambers is equal to or greater than the pressure of the driving fluid in the drive chambers neighboring the pump chambers via the intermediary of the respective diaphragms.

Passageways for supplying the driving fluid are connected to respective ones of the drive chambers and the pressure control means is provided in each passageway at a point along the length thereof.

Thus, the present invention is applicable to a single-diaphragm pump incorporating a single diaphragm and to double-diaphragm pump incorporating two diaphragms. A connecting body is used to guide diaphragm reciprocation where necessary. The connecting body may be a telescoping or simply rod- shaped rod body, a small, disk-shaped plate or a spring such as a helical spring. The connecting body is for suitably supporting the diaphragms in the pump vessel or for interconnecting the diaphragms to assure the proper motion of the diaphragms in the double-diaphragm pump.

Pressure sensing means is provided in the drive chamber or pump chamber or in both of these chambers. Alternatively, however, pressure sensing means is not provided, in which case diaphragm reversal can be prevented by holding the driving fluid at a positive pressure of, say, 0.5 kg/cm$^2$ with respect to the pressure of the pump fluid and producing a differential pressure between the pressure of the driving fluid to the pressure of the pump fluid by a pressure barrier, the differential pressure acting to prevent diaphragm reversal.

The pressure of the pump fluid may rise owing to head pressure or the like even when the diaphragm pump is not operating. In such case diaphragm reversal is caused by the pressure difference between the pump and drive chambers. If a prescribed back pressure that takes head pressure into account is supplied to an air chamber on the side of the drive chamber, diaphragm reversal can be prevented.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of a diaphragm pump according to the present invention will now be described with reference to FIGS. 5 through 8.

Figure 1:
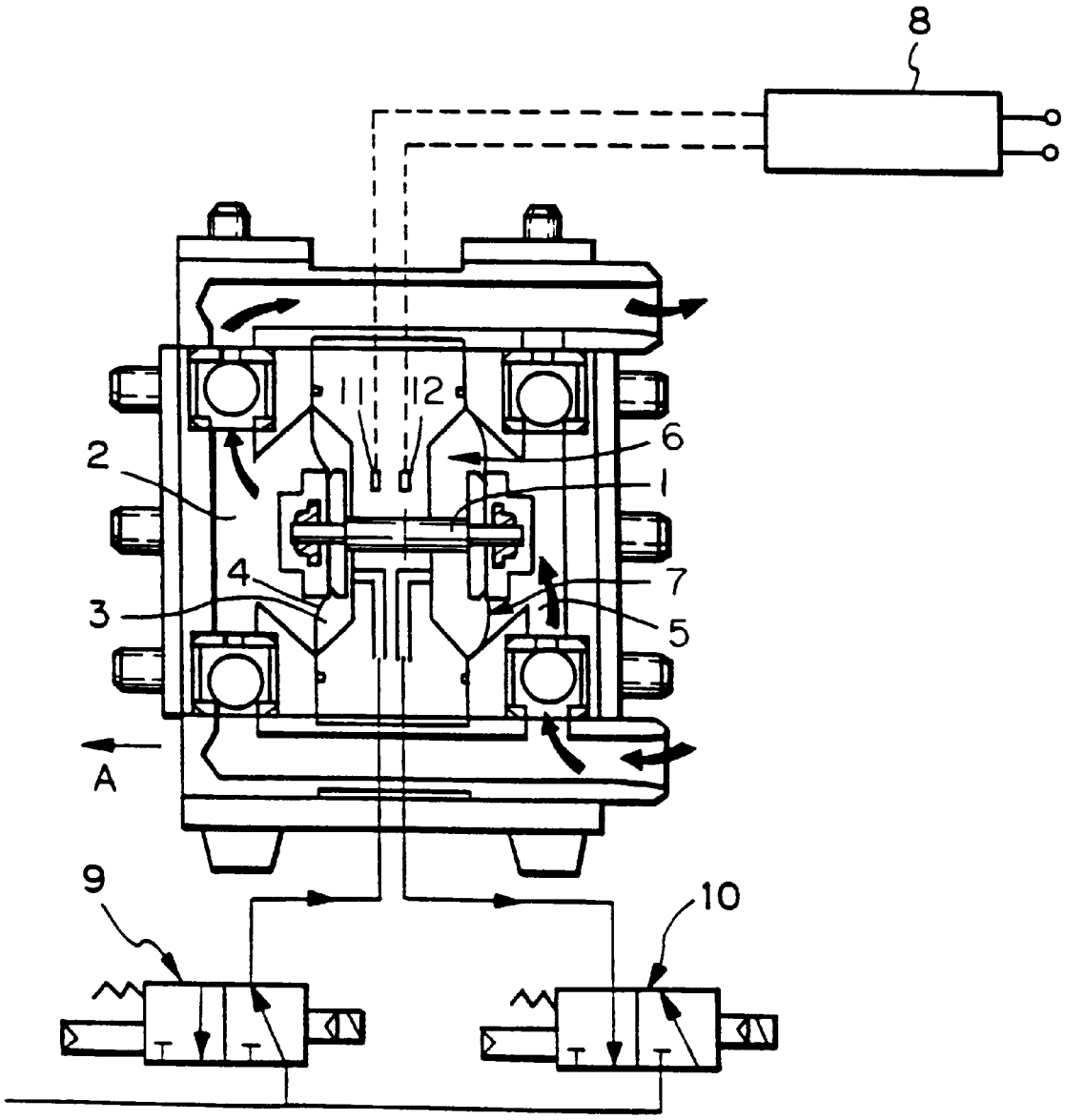
FIG. 1 is a sectional view illustrating a diaphragm pump according to the prior art, the pump being shown in a state which prevails immediately after a reciprocating rod has been moved from a second side to a first side.
Figure 2:
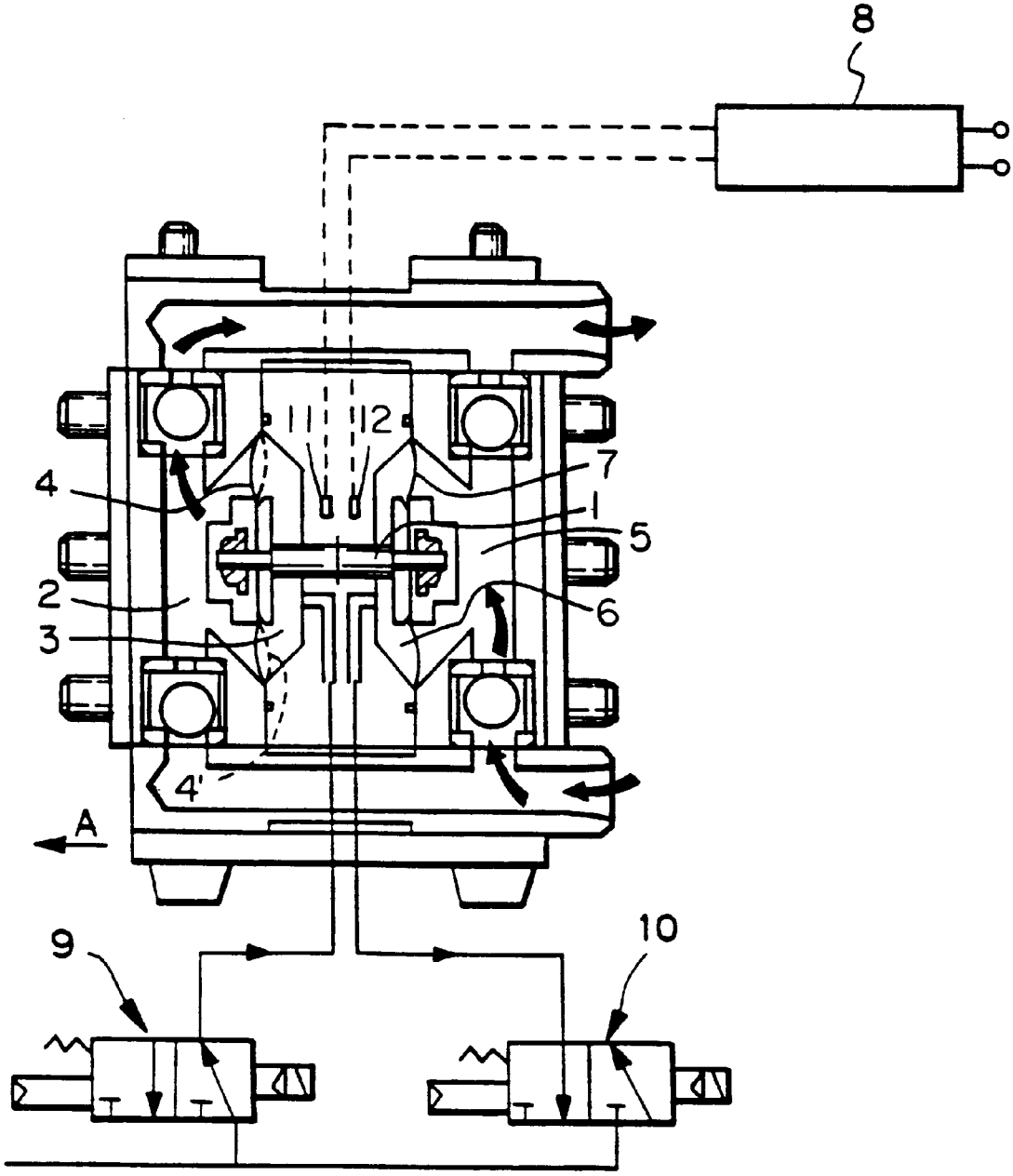
FIG. 2 is a sectional view illustrating the diaphragm pump according to the prior art, the pump being shown in a state which prevails while the reciprocating rod is being moved from the second side to the first side.
Figure 3:
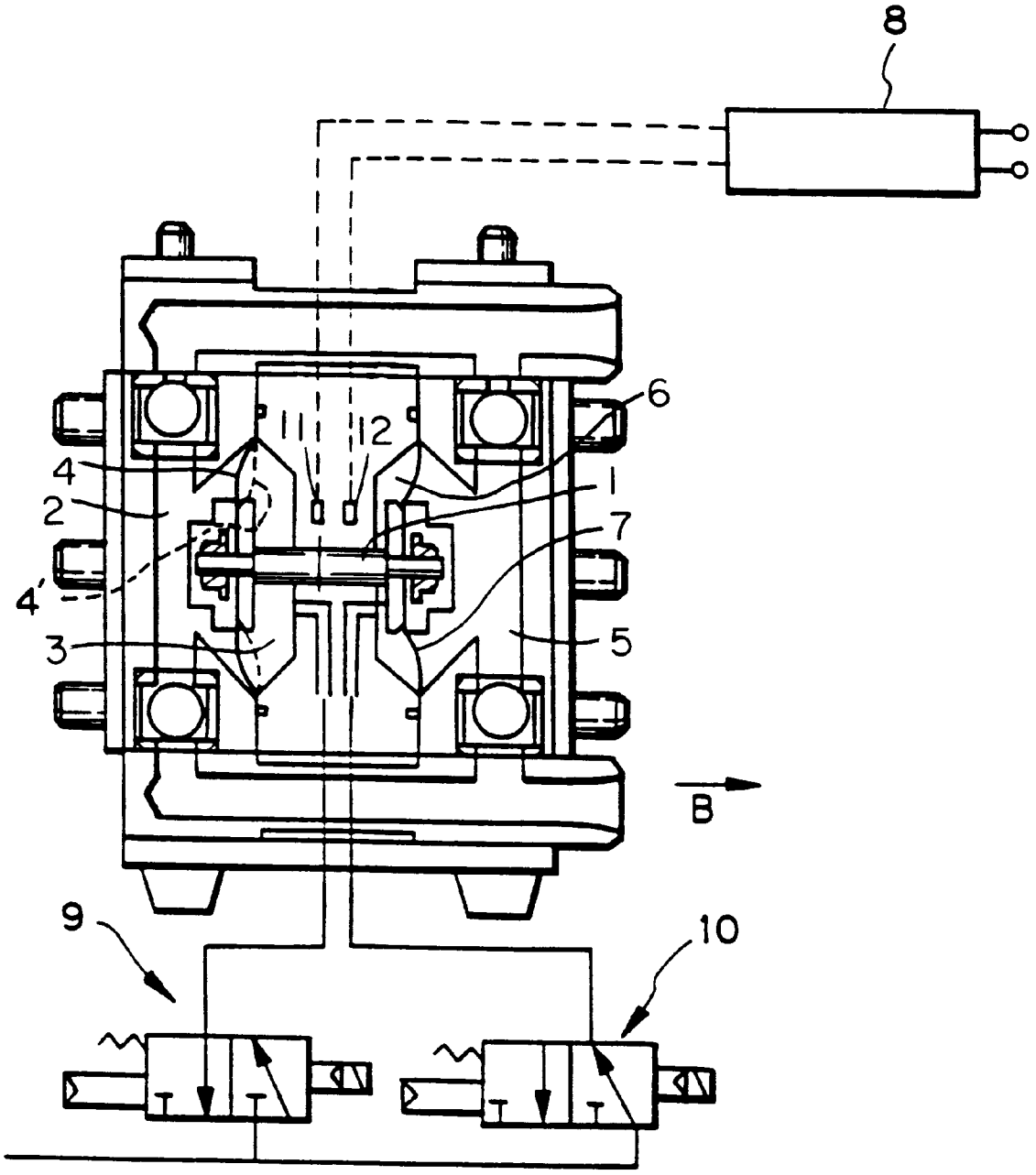
FIG. 3 is a sectional view illustrating the diaphragm pump according to the prior art, the pump being shown in a state which prevails immediately after the reciprocating rod has reached a stopping position on the first side and a changeover control valve has been changed over.
Figure 4:
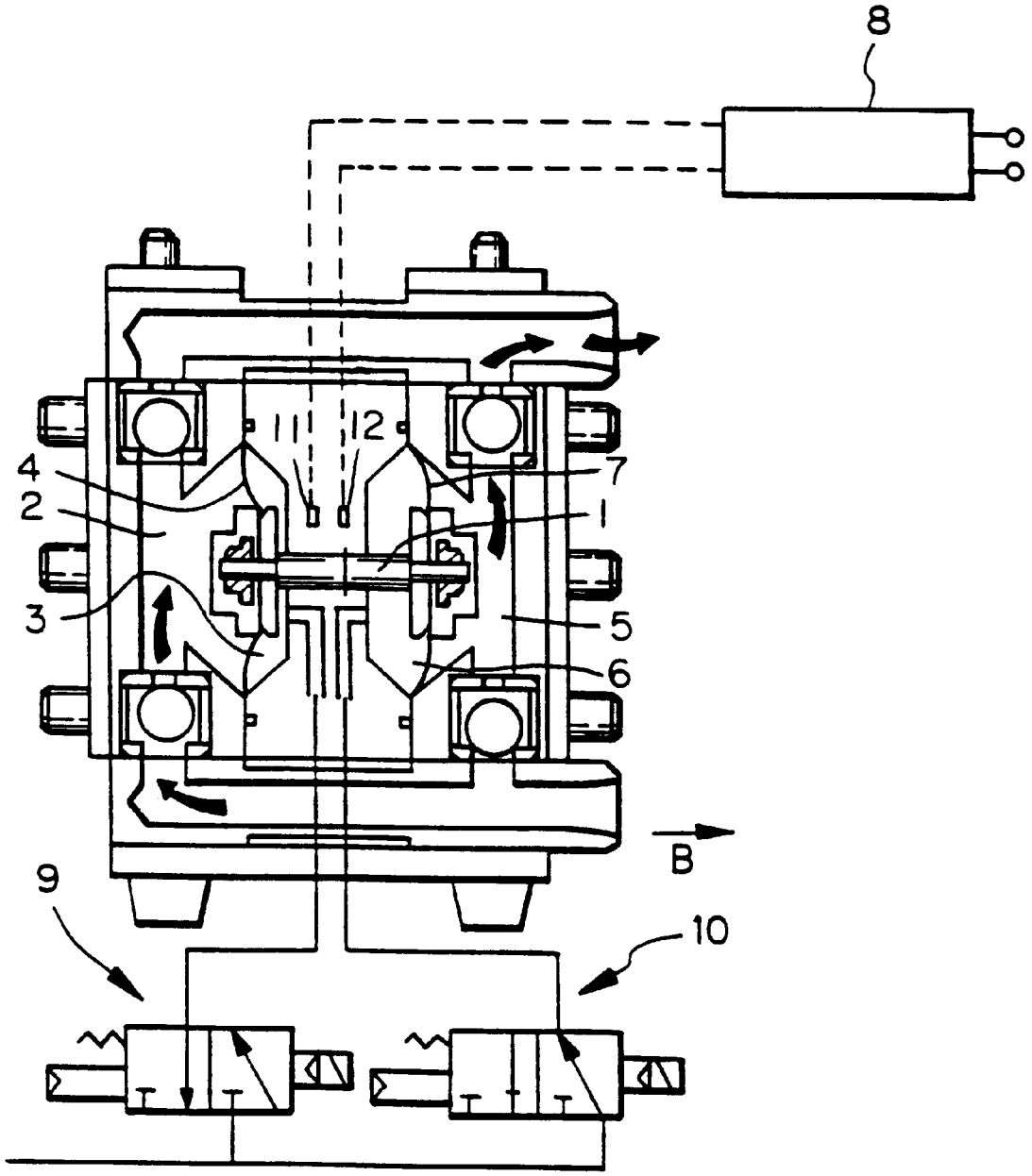
FIG. 4 is a sectional view illustrating the diaphragm pump according to the prior art, the pump being shown in a state which prevails immediately before the reciprocating rod reaches a stopping position on the second side.
Figure 5:
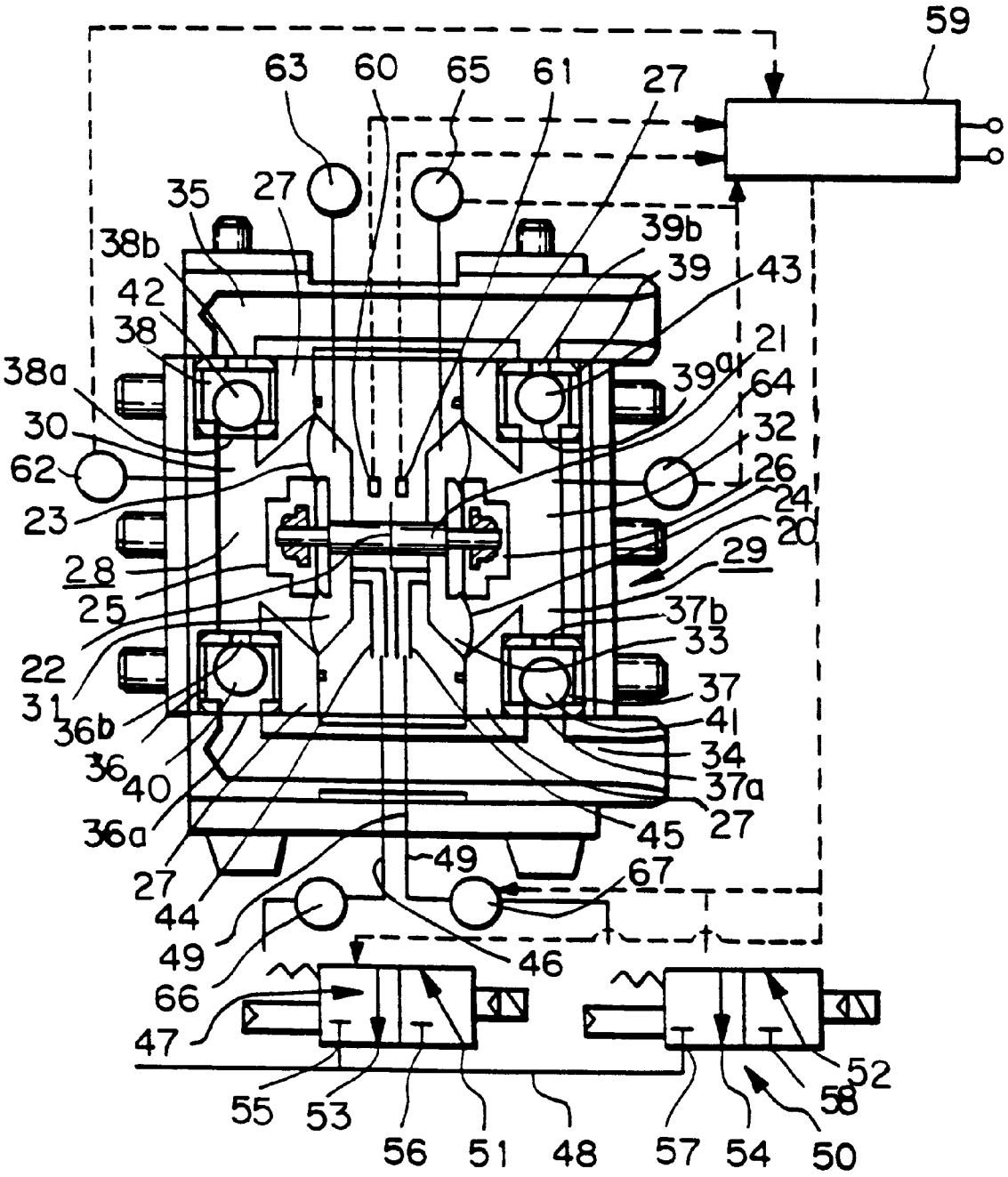
FIG. 5 is a sectional view illustrating a diaphragm pump according to the present invention, the pump being shown in a state in which a reciprocating rod is at a neutral position when the pump is at rest.

As shown in FIG. 5, a reciprocating rod 21 serving as a connecting body is provided at the center of a diaphragm pump housing 20 so as to be movable in the horizontal direction. A ring-shaped magnetic plate 22 is attached to the reciprocating rod 21 at the exact center thereof. One end of the reciprocating rod 21 is provided with a diaphragm 23 and the other end with a diaphragm 24. The diaphragms 23, 24 are secured at their central portions to respective ends of the reciprocating rod 21 by mounting members 25, 26, respectively, and at their circumferential portions to the diaphragm pump housing 20 by mounting members 27. Spaces 28, 29 which allow the movement of the reciprocating rod 21 exist on respective sides of the reciprocating rod 21 in terms of the driving direction thereof. The space 28 is partitioned into a pump chamber 30 and a drive chamber 31 by the diaphragm 23, and the space 29 is partitioned into a pump chamber 32 and a drive chamber 33 by the diaphragm 24. Under ordinary conditions, i.e., in the absence of fluid, the diaphragm 23 is in a state in which it is expanded toward the side of the pump chamber 30 and the diaphragm 24 is in a state in which it is expanded toward the side of the pump chamber 32.

A supply passage 34 for supplying pump fluid to the pump chambers 30, 32 is provided in the lower part of the diaphragm pump housing 20. Provided in the upper part of the diaphragm pump housing 20 is a discharge passage 35 for discharging the pump fluid within the pump chambers to the exterior of the pump. The lower portions of the pump chambers 30, 32 are provided with intake ports 36, 37, respectively, communicating with the supply passage 34. The upper portions of the pump chambers 30, 32 are provided with outlet ports 38, 39, respectively, communicating with the discharge passage 35. The intake ports 36, 37 and outlet ports 38, 39 are provided with ball valves 40, 41, 42, 43, respectively, serving as check valves for opening and closing the respective ports.

The diaphragm pump housing 20 is formed to have passageways 44, 45 communicating with the drive chambers 31, 33, respectively. The passageway 44 is connected to a driving fluid supply pipe 48 via a passageway 46 and a changeover control valve 47, and the passageway 45 is connected to the driving fluid supply pipe 48 via a passageway 49 and a changeover control valve 50. The driving fluid supply pipe 48 functions to supply the drive chambers 31, 33 with air as the driving fluid. The changeover control valves 47, 50 have intake ports 51, 52; discharge ports 53, 54; and stop valves 55, 56; 57, 58, respectively. The changeover control valves 47, 50 are controlled by a controller 59.

The main functions of the controller 59 are to sense the position to which the reciprocating rod 21 has been moved and alternately change over the changeover control valves 47, 50 to thereby control the operation timing of the reciprocating rod 21, and to regulate the pressure of the supplied air as the driving fluid based upon output signals from pressure sensors, described below. The diaphragm pump housing 20 is provided with magnet sensors 60, 61 as proximity sensors confronting the zone in which the magnetic plate 22 reciprocates. The outputs of the magnet sensors 60, 61 are fed into the controller 59.

The pump chamber 30 is provided with a pressure sensor (a capacitor-type pressure-sensitive element or a piezoelectric element) 62 for sensing the pressure of the pump fluid in the pump chamber 30, the drive chamber 31 neighboring the pump chamber 30 is provided with a pressure sensor 63 for sensing the pressure of the driving fluid, the pump chamber 32 is provided with a pressure sensor 64, and the drive chamber 33 neighboring the pump chamber 32 is provided with a pressure sensor 65. The outputs of the pressure sensors 62~65 enter the controller 59.

Provided in the passageways 46, 49 at points along the length thereof are pressure regulators 66, 67 serving as pressure control means for regulating the pressure of the driving fluid which flows into the passageways 44, 45. The pressure regulators 66, 67 are controlled by the controller 59.

The reciprocating rod 21 is located at a neutral position, as shown in FIG. 5, when the diaphragm pump is in the quiescent state. Here the ball valves 40, 41, under their own weight, have closed entrances 36*a*, 37*a* to the intake ports 36, 37 on the side of the supply passage 34; entrances 36*b*, 37*b* on the side of the pump chambers 30, 32 are open. The ball valves 42, 43 have closed exits 38*a*, 39*a* of the discharge ports 38, 39 on the side of the pump chambers 30, 32 and have opened exits 38*b*, 39*b* on the side of the discharge passage 35.

Figure 6:
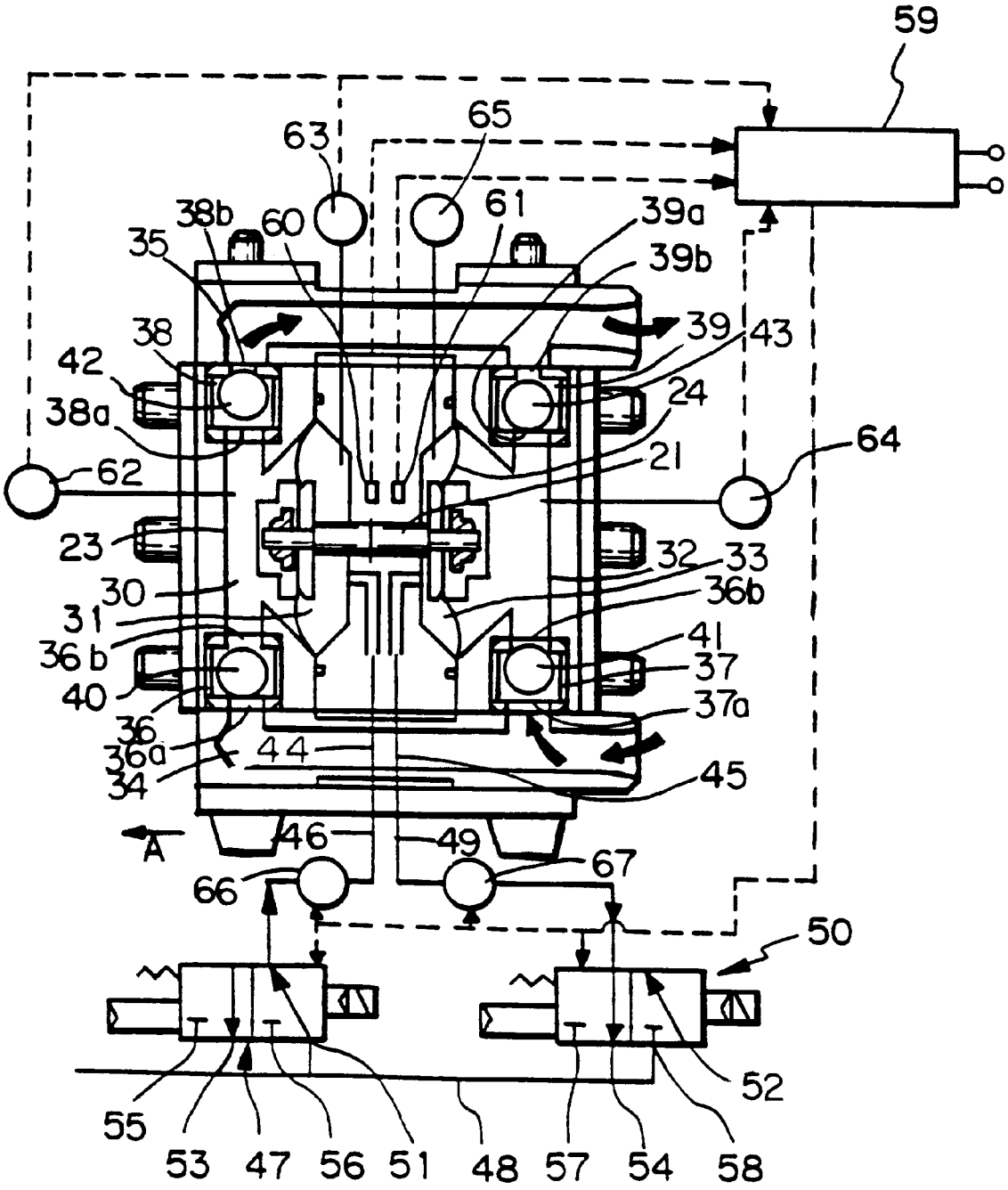
FIG. 6 is a sectional view illustrating the diaphragm pump according to the present invention, the pump being shown in a state in which the reciprocating rod has reached a stopping position on a first side.

Power-supply voltage is applied to the controller 59, whereby the changeover control valve 47 is switched to the side of the intake port 51 and the changeover control valve 50 is switched to the side of the discharge port 54. When this is done the driving fluid is supplied to the drive chamber 31 and the driving fluid is expelled into the atmosphere from the drive chamber 33, whereby the reciprocating rod 21 is driven toward a first side (in the direction of arrow A), as illustrated in FIG. 6. As a result, the volume on the side of the pump chamber 30 decreases and the pressure of the pump fluid rises, thereby urging and displacing the ball valve 42 which is blocking the exit 38*a* of the discharge port 38 on the side of the fluid chamber 30. The discharge port 38 is thus opened. It should be noted that the ball valve 40 continues to keep the entrance 36*a* to the intake port 36 closed. Accordingly, the pump fluid in the pump chamber 30 is discharged to the outside of the pump through the discharge passage 35.

Meanwhile, the volume of the drive chamber 33 decreases and the volume of the pump chamber 32 increases. Consequently, the pressure in the pump chamber 32 declines and the entrance 37*a* to the intake port 37 is opened. The ball valve 43 continues to keep the exit 39*a* to the discharge port 39 closed. Accordingly, pump fluid is supplied to the pump chamber 32 through the supply passage 34.

Figure 7:
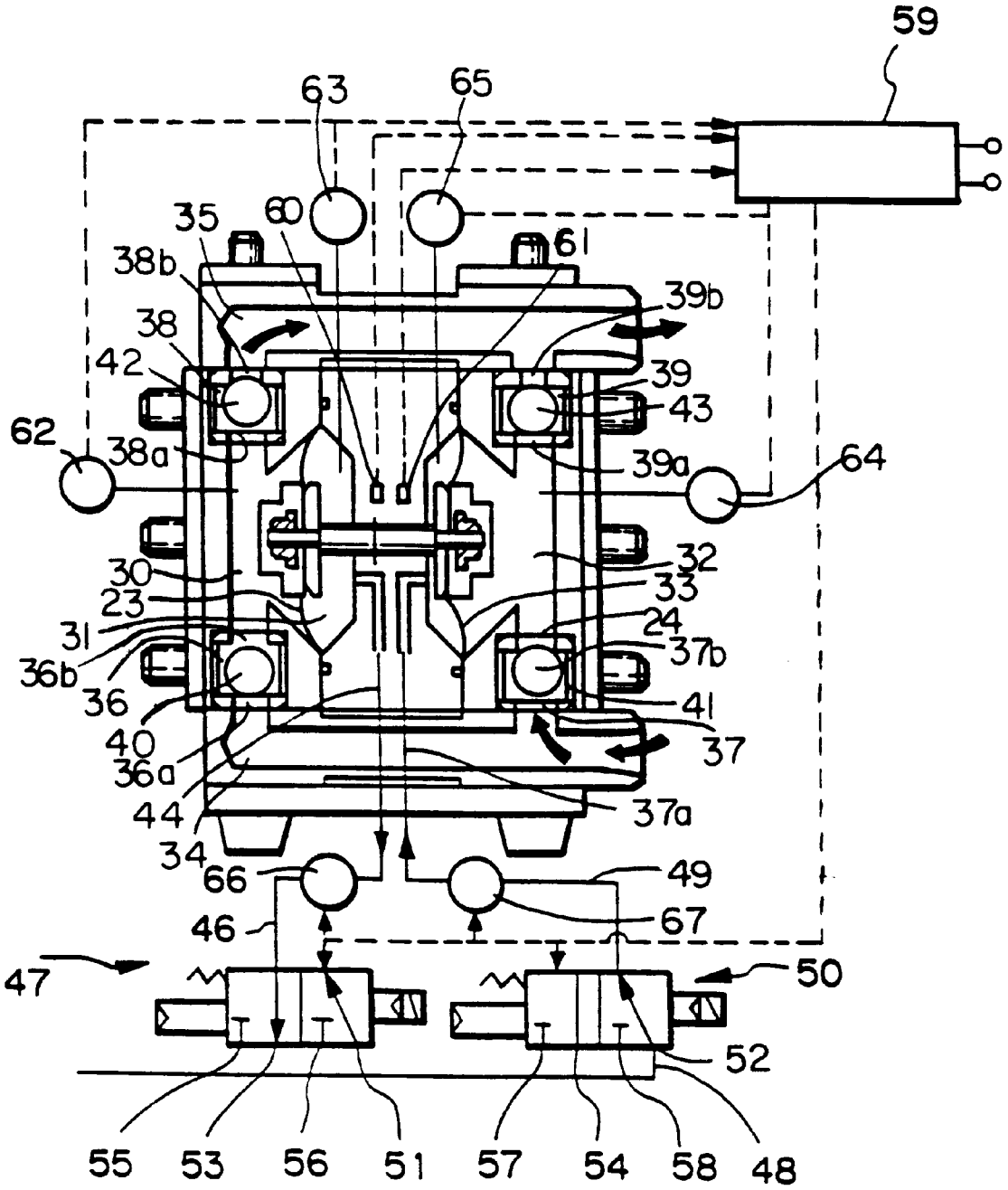
FIG. 7 is a sectional view illustrating the diaphragm pump according to the present invention, the pump being shown in a state which prevails immediately after the reciprocating rod has reached the stopping position on the first side and a changeover control valve has been changed over.
Figure 8:
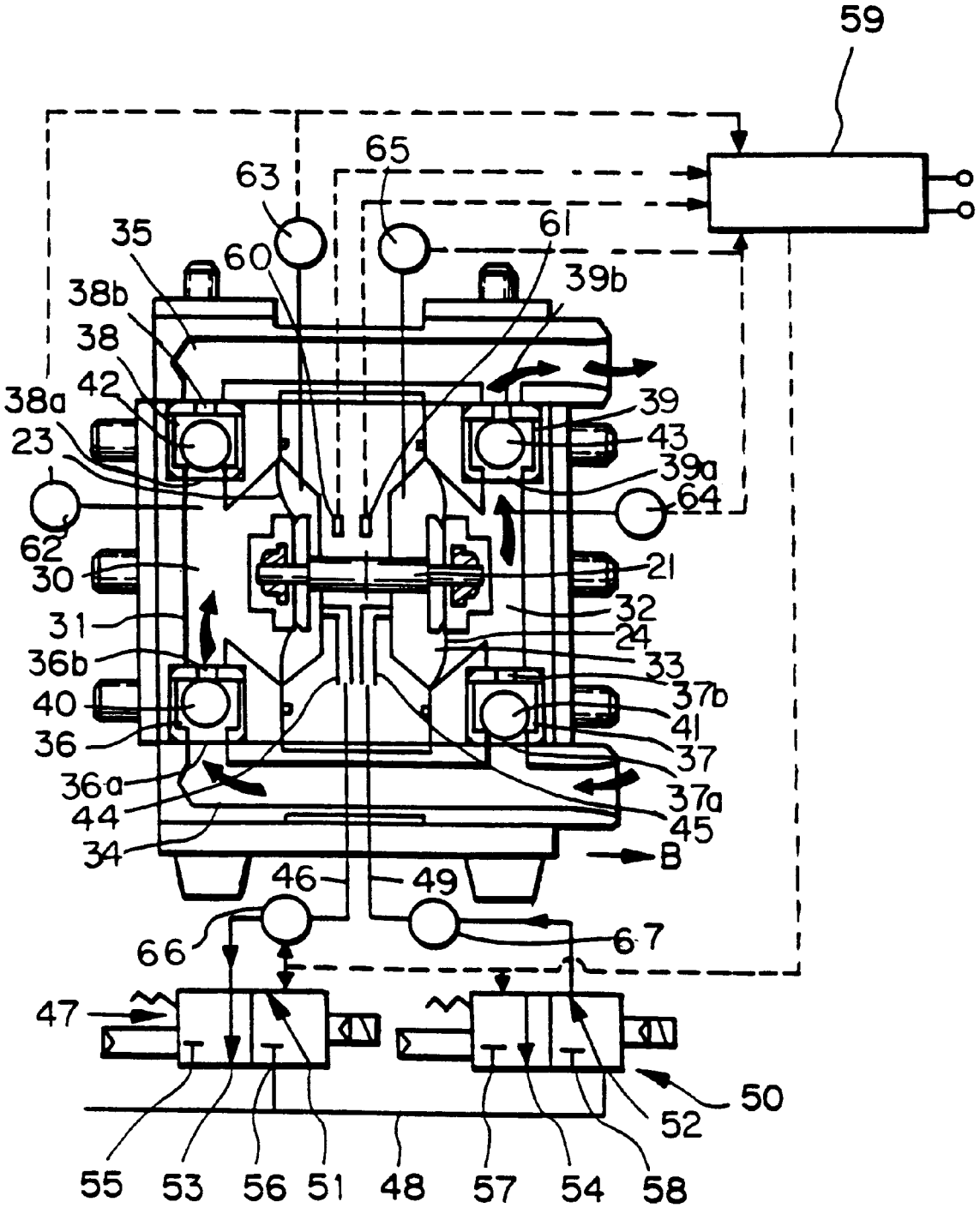
FIG. 8 is a sectional view illustrating the diaphragm pump according to the present invention, the pump being shown in a state which prevails immediately before the reciprocating rod reaches a stopping position on a second side.

When the reciprocating rod 21 reaches its stopping position on the first side, as shown in FIG. 6, the magnet sensor 60 senses the stopping position and the controller 59 responds by switching the changeover control valve 47 to the side of the discharge port 53 and switching the changeover control valve 50 to the side of the intake port 52, as depicted in FIG. 7. Driving fluid is thus supplied to the drive chamber 33 and driving fluid is expelled into the atmosphere from the drive chamber 31 to drive the reciprocating rod 21 toward a second side (in the direction of arrow B), as shown in FIG. 8. As a result, the volume on the side of the pump chamber 32 decreases and the pressure of the pump fluid rises, thereby urging and displacing the ball valve 43 which is blocking the exit 39*a* of the discharge port 39 on the side of the fluid chamber 33. The discharge port 39 is thus opened. It should be noted that the ball valve 41 closes the entrance 37*a* to the discharge port 37. Accordingly, the pump fluid in the pump chamber 32 is discharged to the outside of the pump through the discharge passage 35.

Meanwhile, the volume of the drive chamber 31 decreases and the volume of the pump chamber 30 increases. Consequently, the pressure in the pump chamber 30 declines and the entrance 36*a* to the intake port 36 is opened. Accordingly, pump fluid is supplied to the pump chamber 30 through the supply passage 34.

Assume that the pressure in the pump chamber 30 has surpassed the pressure in the drive chamber 31 for some reason during the reciprocation of the reciprocating rod 21. In such case the controller 59 controls the pressure regulator 66 on the basis of the output signals from the two pressure sensors 62, 63 so as to elevate the pressure of the driving fluid in the drive chamber 31. Next, assume that the pressure in the pump chamber 32 has surpassed the pressure in the drive chamber 33 for some reason during the reciprocation of the reciprocating rod 21. In such case the controller 59 controls the pressure regulator 67 on the basis of the output signals from the two pressure sensors 64, 65 so as to elevate the pressure of the driving fluid in the drive chamber 33.

Thus, in accordance with the present invention, the pressure of the driving fluid in the driving chamber is maintained at a level higher than the pressure of the pump fluid in the pump chamber. This makes it possible to prevent the so-called reversal phenomenon, wherein a diaphragm that should expand toward the pump chamber contracts toward the drive chamber instead during driving of the diaphragm.

Preventing the reversal phenomenon makes it possible to assure reliable, accurate pump operation at all times.

As many apparently widely different embodiments of the present invention can be made without departing from the spirit and scope thereof, it is to be understood that the invention is not limited to the specific embodiments thereof except as defined in the appended claims.

What is claimed is:

1. A diaphragm pump for discharging a pump fluid continuously by a diaphragm defining a pump chamber and a drive chamber, comprising:

pressure control means for controlling pressure of a driving fluid, which is supplied to said drive chamber neighboring said pump chamber via the intermediary of said diaphragm, in such a manner that pressure in said drive chamber becomes higher than pressure in said pump chamber when the pressure in said pump chamber is equal to or greater than the pressure in said drive chamber, whereby reversal of said diaphragm is prevented independently of the pressure in said pump chamber, wherein said pressure control means includes a pressure sensor for sensing the pressure in said pump chamber.

2. A diaphragm pump for discharging a pump fluid continuously by a diaphragm defining a pump chamber and a drive chamber, comprising:

pressure control means for controlling pressure of a driving fluid, which is supplied to said drive chamber neighboring said pump chamber via the intermediary of said diaphragm, in such a manner that pressure in said drive chamber becomes higher than pressure in said pump chamber when the pressure in said pump chamber is equal to or greater than the pressure in said drive chamber, whereby reversal of said diaphragm is prevented independently of the pressure in said pump chamber, wherein said pressure control means includes pressure sensors for sensing the pressure in said drive chamber and the pressure in said pump chamber.

3. A diaphragm pump, which has a pair of diaphragms each of which defines a pump chamber and a drive chamber, for discharging a pump fluid continuously by reciprocation of the pair of diaphragms, comprising: pressure control means for controlling pressure of a driving fluid, which is supplied to said drive chambers neighboring said pump chambers via the intermediary of the respective diaphragms, in such a manner that pressure in said drive chambers becomes higher than pressure in said pump chambers when the pressure in said pump chambers is equal to or greater than the pressure in said drive chambers, whereby reversal of each diaphragm is prevented, wherein said pressure control means includes pressure sensors for sensing the pressure in respective pump chambers.

4. A diaphragm pump, which has a pair of diaphragms each of which defines a pump chamber and a drive chamber, for discharging a pump fluid continuously by reciprocation of the pair of diaphragms, comprising: pressure control means for controlling pressure of a driving fluid, which is supplied to said drive chambers neighboring said pump chambers via the intermediary of the respective diaphragms, in such a manner that pressure in said drive chambers becomes higher than pressure in said pump chambers when the pressure in said pump chambers is equal to or greater than the pressure in said drive chambers whereby, reversal of each diaphragm is prevented, wherein said pressure control means includes pressure sensors for sensing the pressure in respective drive chambers and the pressure in each of respective pump chambers.

5. A diaphragm pump including a connecting body having two ends each of which is provided with a diaphragm defining a pump chamber and a drive chamber, and a control circuit for controlling reciprocation timing of said connecting body as well as timing at which supply of a driving fluid to each of said drive chambers is changed over, wherein when said connecting body is driven toward a first side thereof, the driving fluid is supplied to the drive chamber located on the first side of said connecting body, pump fluid is expelled from the pump chamber located on the first side and pump fluid is drawn into the pump chamber located on a second side of said connecting body while driving fluid is discharged from the drive chamber located on the second side, and when said connecting body is driven toward the second side thereof, the driving fluid is supplied to said drive chamber located on the second side of said connecting body, pump fluid is expelled from said pump chamber located on the second side and pump fluid is drawn into said pump chamber located on the first side of said connecting body while driving fluid is discharged from said drive chamber located on the second side, whereby the pump fluid is discharged continuously by reciprocation of said connecting body, the diaphragm pump comprising:

a pressure sensor provided in each pump chamber for sensing pressure of the pump fluid in each pump chamber;

a pressure sensor provided in each drive chamber for sensing pressure of the driving fluid in each drive chamber; and pressure control means for controlling the pressure of the driving fluid based upon output signals from both of said pressure sensors in such a manner that the pressure of the driving fluid in each drive chamber neighboring each pump chamber becomes higher than the pressure of the pump fluid in the pump chamber when the pressure of the pump fluid in the pump chambers is equal to or greater than the pressure of the driving fluid in the drive chambers neighboring the pump chambers via the intermediary of the respective diaphragms.

6. The diaphragm pump according to claim 5, wherein passageways for supplying the driving fluid are connected to respective ones of said drive chambers and said pressure control means is provided in each passageway at a point along the length thereof.

* * * * *